US005394960A

United States Patent [19]

Yen

[11] Patent Number: 5,394,960

[45] Date of Patent: Mar. 7, 1995

[54] DESCENT DEVICE

[76] Inventor: Kuei-Lin Yen, No. 51, Lane 11, Feng-Le Rd., Pei-Tun Dist., Taichung City, Taiwan, Prov. of China

[21] Appl. No.: 213,904

[22] Filed: Mar. 14, 1994

[51] Int. Cl.[6] ..... B66B 1/26

[52] U.S. Cl. ..... 187/305; 187/306; 187/350; 242/394

[58] Field of Search ..... 187/300, 305, 306, 346, 187/350, 351, 356, 358, 361, 373, 38, 42, 73, 77; 242/394, 394.1, 389

[56] References Cited

U.S. PATENT DOCUMENTS 989,430 4/1911 Sasgen ..... 242/394 X
1,901,279 3/1933 Baldwin ..... 187/38 X
2,193,619 3/1940 Clements ..... 242/394.1
2,402,285 6/1946 Hymans ..... 187/38 X
3,063,679 11/1962 Nusbaum ..... 242/394.1 X
3,276,747 10/1966 Zimmerman ..... 187/38 X
4,556,155 12/1985 Koppensteiner ..... 187/38

*Primary Examiner*—Cheryl L. Gastineau
*Assistant Examiner*—Dean A. Reichard
*Attorney, Agent, or Firm*—Christie, Parker & Hale

[57] ABSTRACT

A descent device includes a load carrier, a winder unit with a coil of cable for suspending the load carrier in mid-air so as to raise or lower the load carrier, and a retarding unit for impeding downward movement of the load carrier so that the load carrier can move downward at a lower speed to ensure safety of the occupants.

7 Claims, 8 Drawing Sheets

DESCENT DEVICE

BACKGROUND OF THE INVENTION

1. Field of the Invention

The invention relates to a descent device, more particularly to a descent device which can control automatically the descending speed of a load carrier.

2. Description of the Related Art

Referring to FIG. 1, a cross sectional view of a conventional descent device 1, which is generally mounted on a tall building for the purpose of escape in the event of a fire, is shown to comprise a load carrier (not shown), a power-operated main rotating shaft 6 with a plurality of brake drums 7 fixed thereon, a manually-operated brake pedal 3, and a reel unit 102 which has a coil of cable 101 wrapped therearound and which is connected operably to the main rotating shaft 6. The coil of cable 101 has one end connected to and suspends the load carrier. When lowering the load carrier downward, the descending speed of the load carrier is faster as it approaches the ground. The descending speed is controlled by actuating of the brake pedal 3. As best illustrated, in order to reduce the descending speed of the load carrier, the brake pedal 3 is compressed against biasing action of a spring 4, wherein the brake shoe 5 will press against the brake drums 7, thereby providing friction to control the descent of the load carrier.

Some of the drawbacks that result from the use of the conventional descent device are as follows:

(I) There is no one to operate the brake pedal 3, when the last escapee wishes to lower himself to the ground. Thus, the load carrier moves at an uncontrolled speed and may result in injuries to the last escapee.

(II) In times of .danger and confusion, the escapees seldom have the presence of mind to operate the brake pedal, thereby causing the load carrier to move at a relatively fast speed or to hang half-way to the ground.

SUMMARY OF THE INVENTION

Therefore, the main objective of the present invention is to provide a descent device which includes a retarding unit that reduces automatically a descending speed of a load carrier, thereby permitting the load carrier to descend at a lower speed.

Accordingly, a descent device of the present invention is provided with a retarding unit which can impede the descent of the load carrier such that the load carrier may descend at a lower speed, thereby ensuring safety of the user. The descent device includes a winder shaft with a coil of cable wound thereon, the coil of the cable having one end connected to and suspending the load carrier, a common shaft parallel to the winder shaft, a sleeve member sleeved rotatably on the common shaft, a gear train which interconnects the sleeve member and the winder shaft, and a ratchet mechanism which interconnects the sleeve member to the common shaft and which permits the common shaft to rotate in a first direction due to rotation of the sleeve member when the latter is driven by the winder shaft in the first direction to lower the load carrier.

In the disclosed embodiment, the sleeve member is shaped as a hollow cylinder with an inner wall and a blind bore that opens at the inner wall. The retarding unit includes a stationary cylindrical casing mounted concentrically around the common shaft. The two ends of the common shaft pass through the stationary casing. A roller is fixed on the common shaft and is disposed within the stationary casing. The roller has two opposed circular flanges, the peripheries of which terminate adjacent to an internal surface of the stationary casing, and a plurality of partitions formed between the flanges. The partitions are angularly spaced from one another so that a plurality of chambers are formed between the flanges. An arc-shaped brake shoe is disposed movably and radially in each of the chambers. When the common shaft rotates in the first direction, the brake shoe in the chamber swings radially away relative to the common shaft to press against the internal surface of the stationary casing. Friction is created to impede the descending movement of the load carrier. Thus, the load carrier descends at a lower speed corresponding to the load carried thereby.

The ratchet mechanism is constituted by an L-shaped notch formed on an external surface of the common shaft which is enclosed by the sleeve member, and a spring-loaded projection which is received in the blind bore of the sleeve member. The spring-loaded projection extends into the L-shaped notch. The L-shaped notch has an abutting face and a sliding face formed perpendicular to the abutting face. When the sleeve member rotates in the first direction, the spring-loaded projection abuts and pushes the abutting face of the L-shaped notch of the common shaft so that the common shaft rotates in the first direction. A driving shaft is disposed adjacent to the common shaft and is connected to the sleeve member operably. When the driving shaft rotates, the spring-loaded projection of the sleeve member moves away from the abutting face of the L-shaped notch and slides past the sliding face of the L-shaped notch such that the sleeve member rotates idly relative to the common shaft in a direction opposite to the first direction. Since the winder shaft is connected operably to the sleeve member, the winder shaft rotates correspondingly with the sleeve member in the same direction to raise the load carrier.

No operator is required to operate the descent device of the present invention. The last person to use the descent device can escape while ensuring that collision of the load carrier with the ground at great speed will not occur.

BRIEF DESCRIPTION OF THE DRAWINGS

Other features and advantages of the present invention will become more apparent in the following detailed description of the preferred embodiments with reference to the accompanying drawings, in which.

DETAILED DESCRIPTION OF THE PREFERRED EMBODIMENTS

Figure 4:
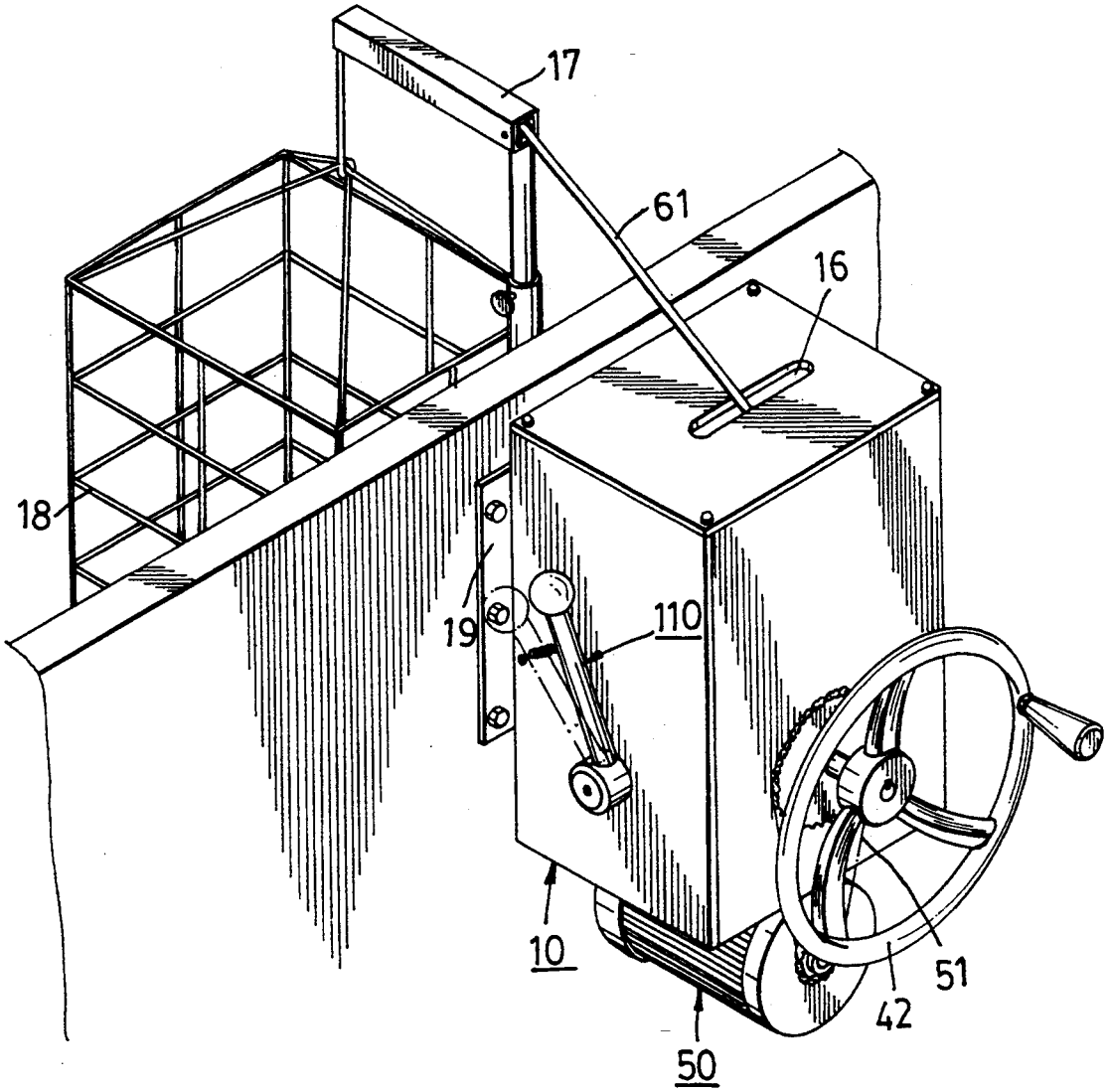
FIG. 4 is a perspective view of the descent device of the present invention.

Referring to FIG. 4, a descent device of the present invention is shown to comprise a load carrier 18 and a winder unit 10 which is mounted fixedly on the wall 19 of a building and which has a coil of cable 61 that extends therefrom and that is connected to the load carrier 18 via a support stand 17, thereby suspending the load carrier 18.

Figure 1:
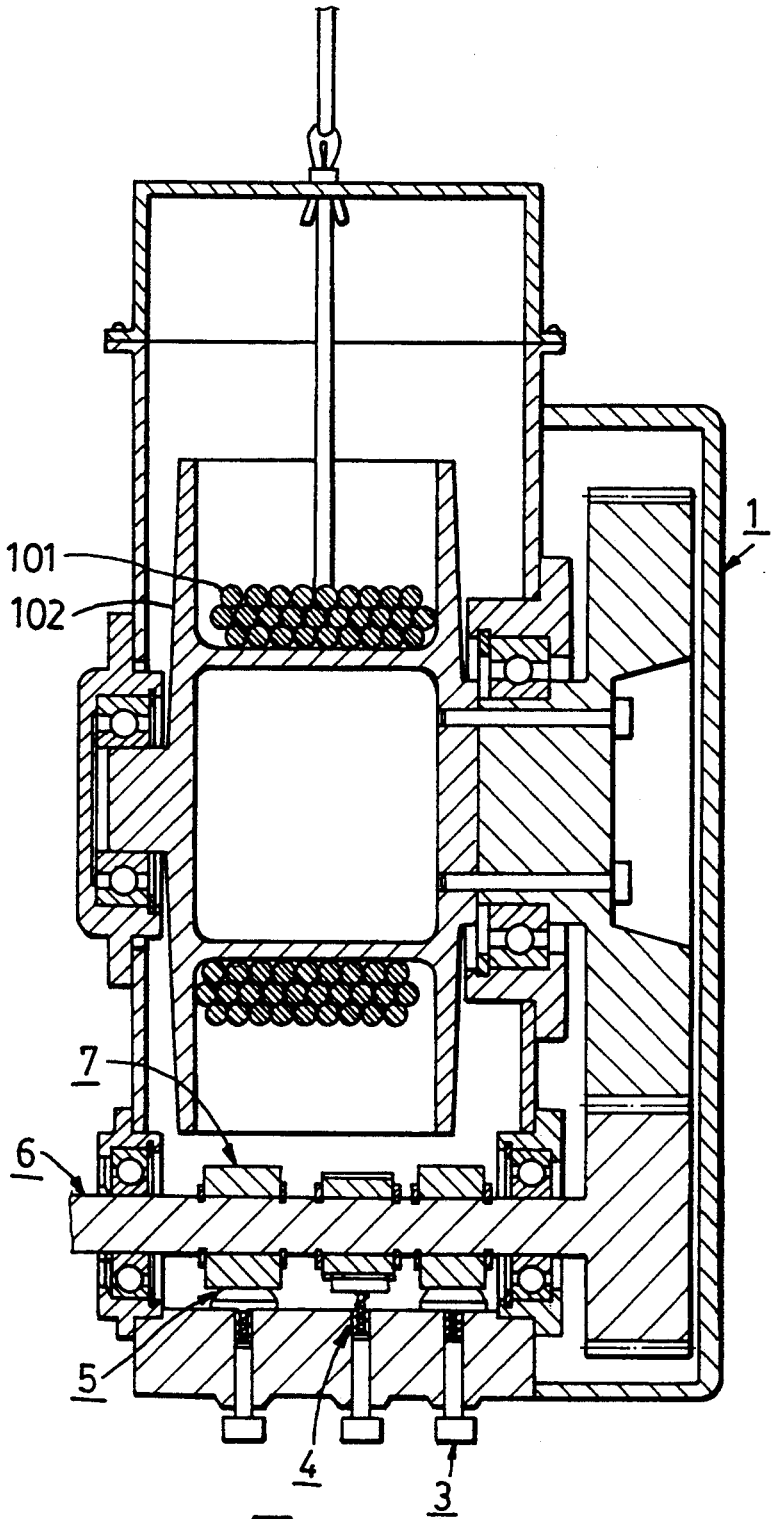
FIG.1 PRIOR ART
FIG. 1 is a cross sectional view of a conventional descent device.
Figure 2:
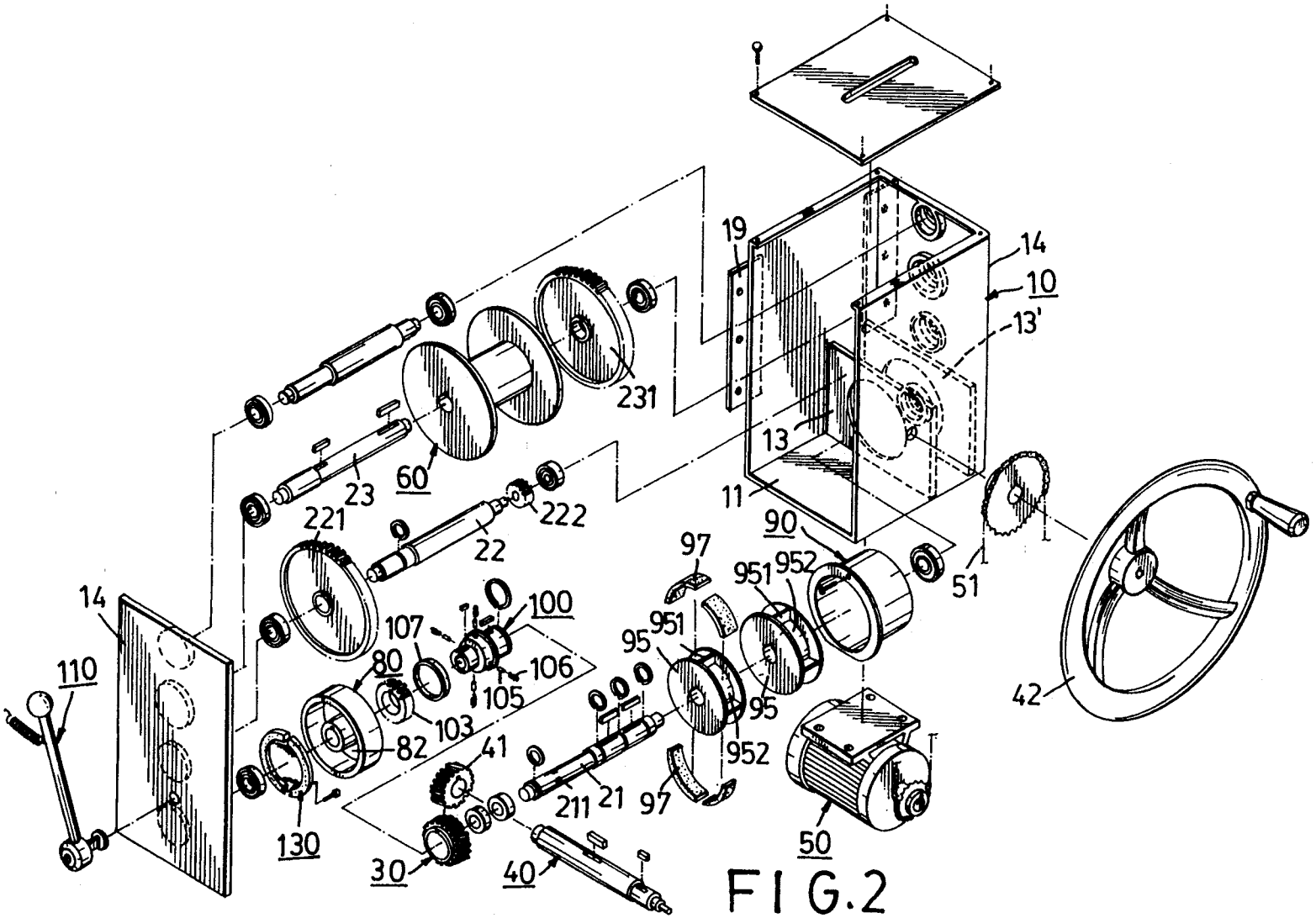
FIG. 2 is an exploded view of a descent device of the present invention without a load carrier attached thereto.
Figure 3:
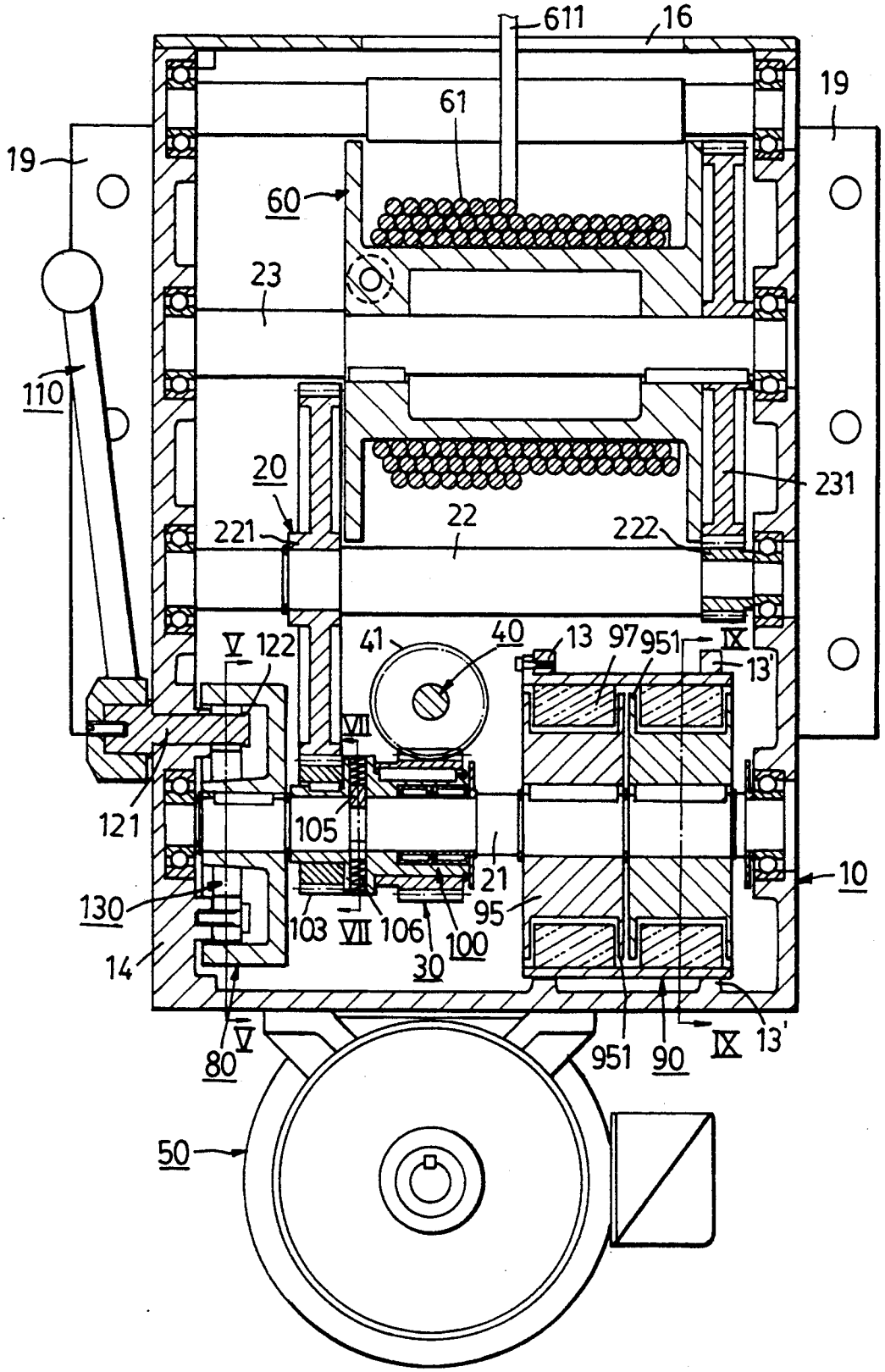
FIG. 3 is a cross sectional view of the descent device shown in FIG. 2 to illustrate its assembly.

Referring to FIGS. 2 and 3, the winder unit 10 comprises a casing which has two opposed walls 14 and a winder shaft 23, a common shaft 21 journalled between the opposed walls 14 and parallel to the winder shaft 23, a driving shaft 40 disposed transverse to the winder and common shafts 21, 23, a gear train, a ratchet mechanism and a retarding mechanism.

Figure 5:
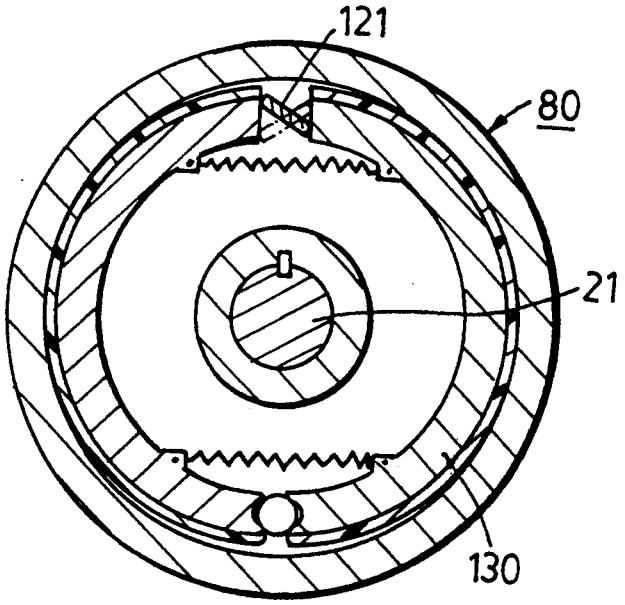
FIG. 5 shows a cross sectional view of a brake assembly employed in the descent device of the present invention, the brake assembly being illustrated in a braked condition.
Figure 6:
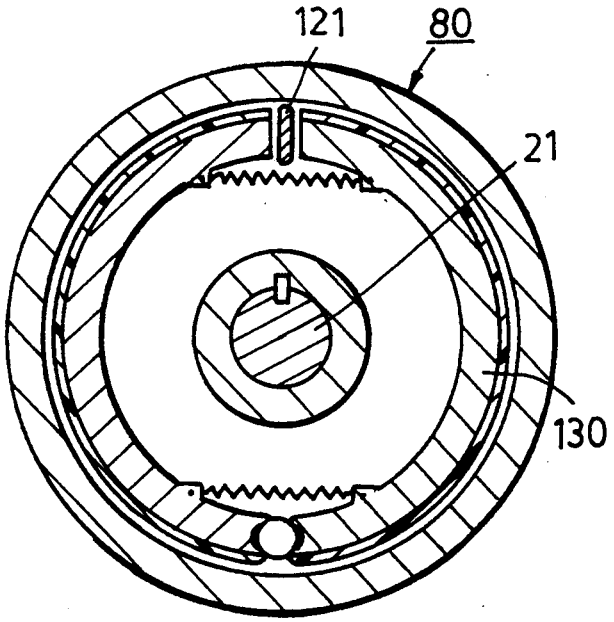
FIG. 6 is a cross sectional view of the brake assembly shown in FIG. 5, the brake assembly being illustrated in a released condition.

The winder shaft 23 has a fixed reel 60 on which the coil of cable 61 is wound. The common shaft 21 has a brake assembly 80 mounted adjacent to one end thereof. The retarding mechanism 90 is mounted adjacent to the other end of the common shaft 21. As shown in FIGS. 2 and 5, the brake assembly 80 includes a stationary brake drum 82 fixed on the common shaft 21 in a conventional manner, two brake shoes 130 disposed inside the brake drum 82 and connected resiliently to one another and a brake pedal 121 for actuating the brake shoes 130. When the brake pedal 121 is at a released condition, the brake shoes 130 are spaced from an inner surface of the brake drum 82, as shown in FIG. 6. Under such a condition, the common shaft 21 can rotate. When the brake pedal 121 is braked, the brake shoes 130 move outward to press against the inner surface of the brake drum 80. Thus, the common shaft 21 cannot rotate.

The retarding mechanism includes a cylindrical casing 90 fixed between two mounting plates 13, 13' of the casing 10 such that two ends of the common shaft 21 pass concentrically therethrough. A pair of rollers 95 are mounted securely on the common shaft 21 and are disposed inside the cylindrical casing 90. Each of the rollers 95 has two opposed circular flanges, the peripheries of which terminate adjacent to an inner surface of the cylindrical casing 90. Four partitions 951 are spaced equally and angularly between the flanges so as to provide the rollers 95 with four chambers 952. Each of the chambers 952 has a brake shoe 97 movable radially therein.

The common shaft 21 further has a cylinder-shaped sleeve member sleeved rotatably thereon between the brake-drum 80 and the cylindrical casing 90. The sleeve member 100 has a first gear 30 fixed thereon.

The gear train includes a second gear 103 fixed on the sleeve member and spaced from the first gear 30, a gear wheel 231 mounted securely on the winder shaft 23, a transmission shaft 22 which is journalled between the winder and common shafts 21, 23 and which has a transmission gear 221 that meshes with the second gear 103 of the sleeve member 100 and a transmission pinion 222 that meshes with the gear wheel 231 of the winder shaft 23. Thus, the winder shaft 23, the transmission shaft 22 and the sleeve member 100 are interconnected to one another.

Referring to FIGS. 2 and 4, the ratchet mechanism is constituted by four L-shaped notches 211 formed on an external surface of the common shaft 21 which is enclosed by the sleeve member 100, four through bores formed through the sleeve member 100, and a slip ring 107 sleeved over the sleeve member 100 so as to close one end of the through bores to form four blind bores 106. Each of the L-shaped notches 211 has an abutting face 2110 and a sliding face 2111. Each of the blind bores 106 has a spring-loaded projection 105 received therein. The spring-loaded projection 105 extends into the respective notch 211 to abut the abutting face 2110 of the latter at the normal condition. In this embodiment, the driving shaft 40 is connected to a motor 50 via a driving chain 51. To facilitate turning of the driving shaft 40 in case of power failure, a turning wheel 42 is fixed at one end of the driving shaft 40 so that the driving shaft 40 may be rotated manually to permit raising of the load carrier 18 in order to carry escapees downward.

Figure 7:
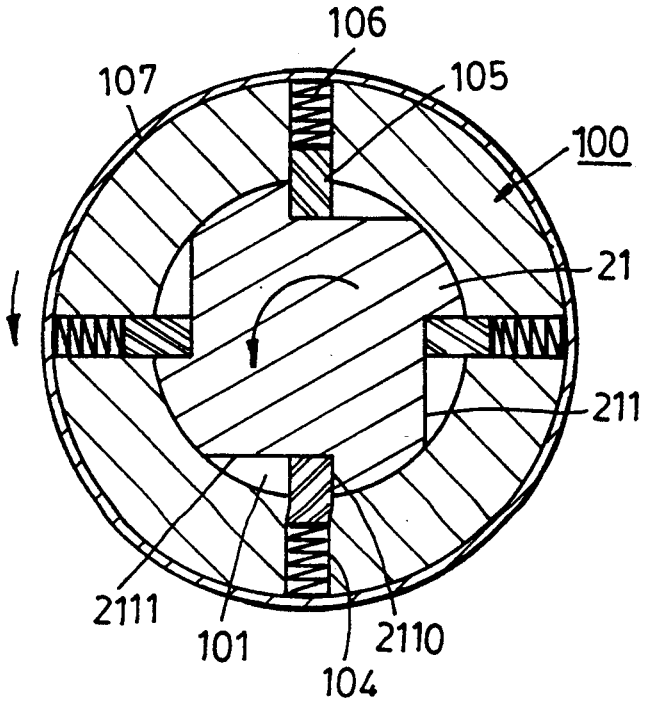
FIG. 7 is a cross sectional view of FIG. 3 taken along the line VII—VII, illustrating a sleeve member when rotating in a first direction.

Referring to FIGS. 3 and 4, the brake pedal 121 is connected to an actuating rod 110 which is connected resiliently adjacent to the wall 19 of the building. In use, the actuating rod 110 is pressed so as to release the brake pedal 110 from the braked position (as shown by the phantom lines). The winder shaft 23 rotates due to the load carried by the load carrier 18 so that the load carrier 18 can be lowered downward. The sleeve member 100, being connected to the winder shaft 23 via the transmission shaft 22, rotates together with the winder shaft 23, wherein the spring-loaded projection 105 of the sleeve member 100 pushes the common shaft 21 to rotate in a first direction, as shown in FIG. 7. Rotation of the common shaft 21 swings the brake shoes 97 in the cylindrical casing 90 radially outward to press against the inner surface of the cylindrical casing 90, thereby generating friction to reduce the rotating speed of the common shaft 21. Thus, movement of the load carrier 18 is impeded so that the load carrier 18 travels at a uniform speed within a short time after it begins to descend. The load carrier 18 can move at a uniform speed because the friction that is generated is directly proportional to the rotational speed of the common shaft 21.

Figure 8:
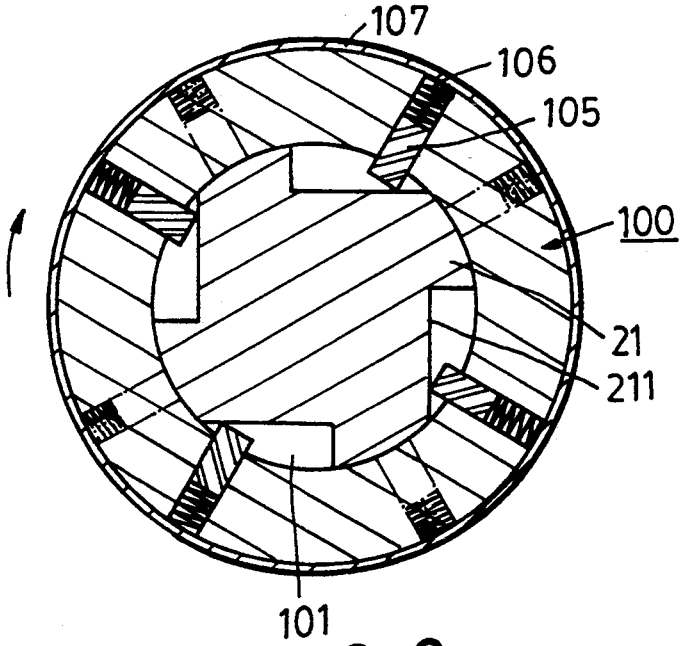
FIG. 8 illustrates the sleeve member shown in FIG. 7 when rotating in a second direction.
Figure 9:
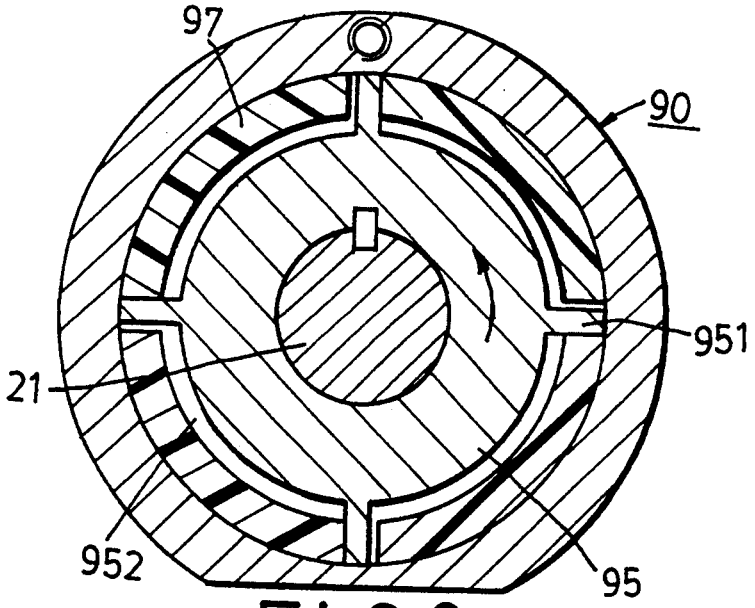
FIGS. 9 and 10 respectively illustrate cross sectional views of a retarding unit employed in the descent device of the present invention in a used condition.
Figure 10:
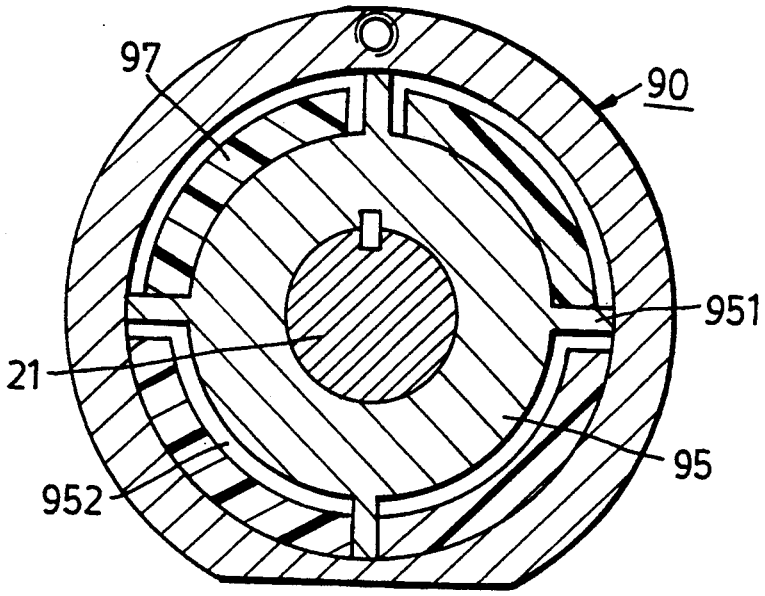

To raise the load carrier 18 upward so as to lower a second batch of escapees, the brake pedal 121 is braked so as to retain the common shaft 21 at a stationary condition. Note that the driving shaft 40 can be power-operated. In the event of power failure, the driving shaft 40 is operated by rotating manually the turning wheel 42. The sleeve member 100 rotates simultaneously with the driving shaft 40 in a second direction which is opposite to the first direction. When the sleeve member 100 rotates in the second direction, the spring-loaded projection 105 of the sleeve member 100 moves away from the abutting face 2110 and slides past the sliding face 2111 of the common shaft 21, as shown in FIG. 8. Thus, the sleeve member 100 rotates in the second direction idly with respect to the common shaft 21. Since the winder shaft 23 is connected operably with the sleeve member 100 via the transmission shaft 22, the winder shaft 23 rotates in the second direction together with the sleeve member 100 to move the load carrier 18 upward.

Note that the operator can stop the movement of load carrier 18 by operating the brake pedal 121, thus permitting the escape of the occupants of lower storeys in case of fire.

Figure 11:
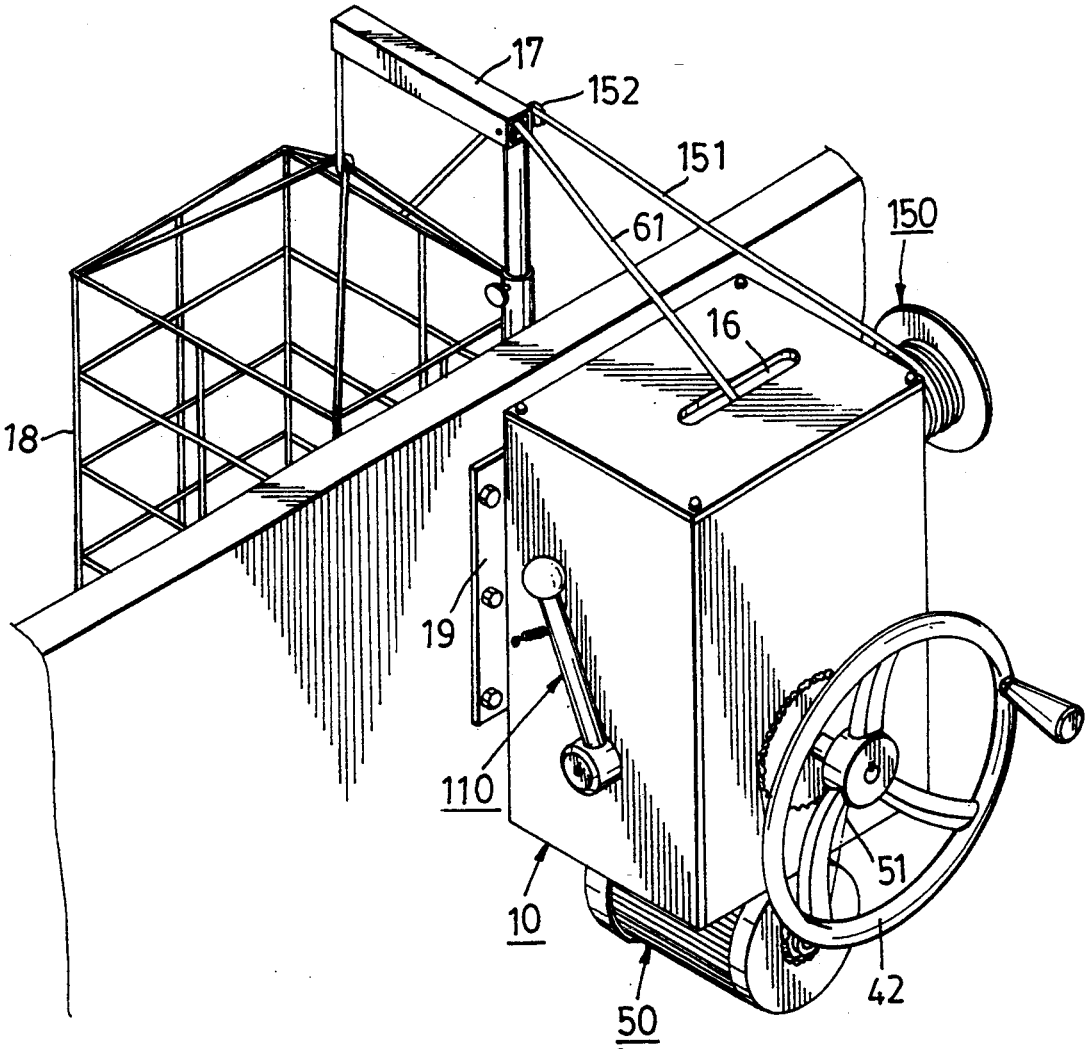
FIG. 11 shows another preferred embodiment of the present invention.

Referring to FIG. 11, another preferred embodiment is shown to be substantially similar to the previous embodiment except that an additional reel 150 is mounted on one end of the winder shaft which protrudes out of the casing 10. A second coil of cable 151 is wound thereon and has one end connected to the load carrier 18 via a pulley 152. This provision prevents the load carrier 18 from rotating around itself when being lowered.

While the present invention has been described in connection with what is considered the most practical and preferred embodiments, it is understood that this invention is not limited in the disclosed embodiments, but is intended to cover various arrangements included within the spirit and scope of the broadest interpretation so as to encompass all such modifications and equivalent arrangements.

I claim:

1. A descent device including a load carrier, a power operated winder unit with a coil of cable, said coil of cable having an end connected to and suspending said load carrier such that operation of said winder unit can lower or raise said load carrier, and a brake unit for retaining said load carrier at a stationary position when-braked;

wherein the improvement comprises:

said winder unit including a winder shaft and a common shaft parallel to said winder shaft, said coil of cable being wrapped around said winder shaft, and a power-operated driving shaft provided adjacent to said common shaft, said common shaft having a sleeve member sleeved rotatably thereon, said sleeve member having a first gear fixed thereon, a gear train interconnecting said winder shaft and said sleeve member, a ratchet mechanism interconnecting said sleeve member to said common shaft and permitting said common shaft to rotate in a first direction due to rotation of said sleeve member when said sleeve member is driven by said winder shaft in said first direction, said driving shaft having a driving gear meshing with said first gear of said sleeve member such that operation of said driving shaft causes rotation of said sleeve member in a direction opposite to said first direction and corresponding rotation of said winder shaft to raise said load carrier;

said common shaft further having a retarding mechanism for impeding rotation of said common shaft so that said common shaft rotates at a lower speed to lower said load carrier when said common shaft is rotated in said first direction; and said brake unit being attached to said common shaft so as to retain said common shaft at a stationary condition when braked, said brake unit permitting said common shaft to rotate at said lower speed in said first direction upon release thereof.

2. The descent device as defined in claim 1, wherein said driving shaft further includes a turning wheel to permit manual rotation thereof.

3. The descent device as defined in claim 1, wherein said ratchet mechanism is constituted by an L-shaped notch formed on an external surface of said common shaft which is enclosed by said sleeve member, said sleeve member defining an internal surface which abuts with said external surface of said common shaft and having a blind bore which opens at said internal surface to receive a spring-loaded projection therein, said spring-loaded projection extending resiliently into said L-shaped notch, said L-shaped notch including a sliding face and an abutting face which is substantially perpendicular to said sliding face, said abutting face being pushed by said spring-loaded projection when said sleeve member rotates in said first direction, thereby moving said common shaft in said first direction, said spring-loaded projection moving away from said abutting face and sliding past said sliding face of said L-shaped notch to permit idle rotation of said sleeve member relative to said common shaft when said sleeve member is rotated in said second direction.

4. The descent device as defined in claim 1, wherein said retarding mechanism includes a stationary cylindrical casing mounted concentrically around said common shaft, said common shaft having two ends passing through two opposed ends of said cylindrical casing and a roller mounted securely thereto and disposed within said casing, said roller having two opposed circular flanges with peripheries terminating adjacent to an inner surface of said casing and a plurality of angularly spaced partitions formed between said opposed flanges to divide said roller into a plurality of chambers, said retarding mechanism further including an arc-shaped brake shoe provided radially and movably in each of said chambers such that rotation of said common shaft swings said brake shoe away from said common shaft so as to abut against said inner surface of said casing, thereby causing friction between said inner surface of said casing and said brake shoes to impede rotation of said common shaft when said common shaft is rotated in said first direction.

5. The descent device as defined in claim 1, wherein said gear train includes a second gear mounted fixedly on said sleeve member, a transmission shaft parallel to and journalled between said winder and common shafts, said transmission shaft having a transmission gear meshing with said second gear of said sleeve member and a transmission pinion, and a gear wheel mounted on said winder shaft and meshed with said transmission pinion of said transmission shaft.

6. The descent device as defined in claim 1, wherein said driving shaft is disposed transverse to said common shaft.

7. The descent device as defined in claim 1, wherein said winder shaft has a reel fixed thereon, said coil of cable being wound around said reel.

* * * * *